US005456048A

United States Patent [19]

White

[11] Patent Number: 5,456,048

[45] Date of Patent: Oct. 10, 1995

[54] MUNTIN CLIP

[75] Inventor: John P. S. White, Smyrna, Tenn.

[73] Assignee: Caradon Better-Bilt, Inc., Smyrna, Tenn.

[21] Appl. No.: 166,129

[22] Filed: Dec. 13, 1993

[51] Int. Cl.[6] ..... E04B 1/61

[52] U.S. Cl. ..... 52/204.61; 52/456; 52/656.8; 403/218; 403/174

[58] Field of Search ..... 52/204.61, 456, 52/314, 85, 656.8, 656.9; 403/217, 218, 219, 174, 170, 178, 113, 119, 161

[56] References Cited

U.S. PATENT DOCUMENTS

| | | | |
|---|---|---|---|
| 6,000,893 | 3/1898 | Potter . | |
| 2,115,953 | 5/1938 | Hohmeister . | |
| 2,186,540 | 1/1940 | Boulton | 403/113 |
| 2,307,657 | 1/1943 | Anderson . | |
| 3,358,412 | 1/1967 | Martin | 52/456 |
| 3,925,595 | 12/1975 | Hawkins . | |
| 3,940,553 | 2/1976 | Hawkins . | |
| 3,967,803 | 7/1976 | Kienlen et al. . | |
| 4,437,284 | 3/1984 | Cribben et al. | 52/456 |
| 4,505,609 | 3/1985 | Vella | 403/174 X |
| 4,544,203 | 10/1985 | Younger et al. . | |
| 4,637,748 | 1/1987 | Beavers | 403/217 X |
| 4,640,642 | 2/1987 | Magid et al. | 403/161 X |
| 5,154,034 | 10/1992 | Stanek | 52/456 |
| 5,274,976 | 1/1994 | Burkhart | 52/314 X |

FOREIGN PATENT DOCUMENTS

| | | | |
|---|---|---|---|
| 0033607 | 7/1928 | France | 403/161 |
| 0008208 | 6/1956 | Germany | 403/113 |
| 0010296 | 4/1897 | United Kingdom | 403/161 |

OTHER PUBLICATIONS

Advertising page showing muntin clips "Hygrade Makes it Happen", Hygrade Metal Molding Mfg. Corp., 540 Smith St. Farmingdale, N.Y. 11735.

*Primary Examiner*—Wynn E. Wood
*Attorney, Agent, or Firm*—Robert A. Seemann

[57] ABSTRACT

A muntin bar joiner includes adjustable tabs for attachment to muntin bars. The tabs may be rotated about an axis to customize the joiner for holding the bars in accordance with the muntin assembly design. The tabs move in a common plane when rotating, while parts of the tabs may move over one another. The tabs are interchangeable to accommodate different bar designs.

6 Claims, 6 Drawing Sheets

MUNTIN CLIP

BACKGROUND OF THE INVENTION

1. Field of the Invention

This invention pertains in general to windows in static structures, such as double glass window sandwich panels which are installed in building walls and doors, and more particularly to a versatile muntin bar joiner, also called "muntin clip", for forming a custom muntin design assembly within the parallel facing glass member sandwich, the design incorporating a plurality of angles between the muntin bars.

2. Description of the Prior Art

A muntin design includes two or more muntin bars joined by a muntin clip. Each bar usually runs from the clip to a combination frame and spacer which spaces one glass member from the other and preferably provides an air tight seal between the glass members at the perimeter of the sandwich.

Examples of Prior Art clips are shown in FIGS. 1–10.

Before explaining the present invention in detail under the heading "DESCRIPTION OF THE PREFERRED EMBODIMENTS", a description of the prior art is now provided with reference to FIGS. 1–10 for a better understanding of the present invention and its advantages.

FIGURES OF PRIOR ART

FIG. 1 is a front view of a window assembly having a prior art muntin assembly.

FIG. 2 is a cross section view of the window shown in FIG. 1 taken along the line 2—2.

FIG. 3 is a front view of the muntin clip shown in FIG. 2, complete and enlarged.

FIG. 4 is a front view of a window assembly having a prior art muntin assembly.

FIG. 5 is a front view of the muntin clip shown in FIG. 4, complete and enlarged.

FIG. 6 is a front view of a prior art muntin clip.

FIG. 7 is a front view of a prior art muntin clip.

FIG. 8 is a front view of a prior art muntin clip.

FIG. 9 is a front view of a prior art muntin clip.

FIG. 10 is a top perspective end view of a muntin bar designed to attach to the muntin clip shown in FIG. 9.

Referring to FIGS. 1, 2 and 3, window frame 20 includes aluminum outer frame 26 which encloses a sandwich of two parallel, facing panes of glass or lights 30 and 32, sealed around their perimeter by a combination spacer and seal 34. One such spacer and seal, a "Swiggle" (tm) is available from Tremco Inc., 3735 Green Rd., Beachwood, Ohio 44122. Surrounding the sandwich, between spacer 34 and frame 20, is rubberlike support gasket 40 which supports the sandwich, protects the sandwich from differential expansion and contraction between the sandwich and frame, and provides insulation against weather and sound.

Muntin design assembly 44 mounted between lights 30 and 32 is preferably in a plane that is parallel with the lights. As shown in FIG. 2, however this is not always the case. It is difficult to align and seal the muntin design parallel with the lights. Nevertheless, the space between the lights is shallow, and one looking through the window in a direction generally normal to the lights, is normally not aware of the tilt of the muntin design.

Muntin bars 48, 50 and 52 are attached together by muntin clip 54 which includes attachment tabs 58 for attaching the muntin bars to the clip. A muntin clip 62 may also be used to attach bar 52 to bars 66 and 68, although bars 52 and 68 may be a single bar attached to bar 66 by a T clamp which wraps around the single bar 52–68.

Referring now to FIGS. 4 and 5, muntin design 74 uses muntin clip 76. Each pair of rods 78 is an attachment means for attaching a rectangular end muntin bar to the clip in the manner of an attachment tab 58 shown in FIG. 3.

Muntin clips 54 and 76 are custom molded to match angles 80 and 82 of designs 44 and 74, which are 38.03 degrees and 32.34 degrees respectively.

Present clips are molded at fixed angles to suite standard angles such as 60 and 90 degrees, and non standard angles for custom designs. A window manufacturer must therefore keep a large inventory of standard sizes, and have non-standard sizes custom manufactured for many jobs at considerable cost, in money and delay.

FIGS. 6, 7, and 8 show standard angles of 30, 45 and 90 degrees. Referring to FIGS. 9 and 10, non-standard, custom muntin clip 86 fits muntin bar 88.

Raised key 92 on graduated-step tab 94 fits keyway slot 96 of rectangular opening 98.

SUMMARY OF THE INVENTION

It is one object of the present invention to provide a muntin bar joiner which has muntin bar attachment means that are adjustable to fit a variety of muntin designs.

It is another object of the invention to provide a muntin bar joiner in which the means for attachment to muntin bars is infinitely adjustable within a predetermined angular range.

It is another object that the adjustable attachment means be removable from the joiner.

It is another object that the adjustable attachment means includes a tab that is interchangeable with a different tab.

Other objects and advantages will become apparent to one reading the ensuing description.

In the present invention a muntin bar joiner has an axis and pivot core means centered on the axis. A first means for attachment to a muntin bar is mounted on the pivot core means, for rotation about the axis. A second means for attachment to a muntin bar is mounted on the pivot core means, for rotation about the axis with respect to the first means for attachment.

The first means for attachment is removably held on the pivot core means by retainer means comprising a raised portion of an axial end of the pivot core means, and the second means for attachment is molded as one piece with the pivot core means.

The first means for attachment is adapted for moving in the same plane as the second means for attachment when the first means for attachment is rotating about the axis.

A portion of the first means for attachment is also adapted for moving across a portion of the second means for attachment when the first means for attachment is rotating about the axis.

A third means for attachment to a muntin bar is mounted on the pivot core means, for rotation about the axis with respect to the first means for attachment.

Either one of the first means for attachment, the second means for attachment, or the third means for attachment is adapted for moving in the common plane of the other two means for attachment when the above either one is rotating about the axis.

BRIEF DESCRIPTION OF THE DRAWINGS

In order that the invention be more fully comprehended, it will now be described, by way of example, with reference to the accompanying drawings, in which:

FIGURES OF THE PRESENT INVENTION

Figure 11:
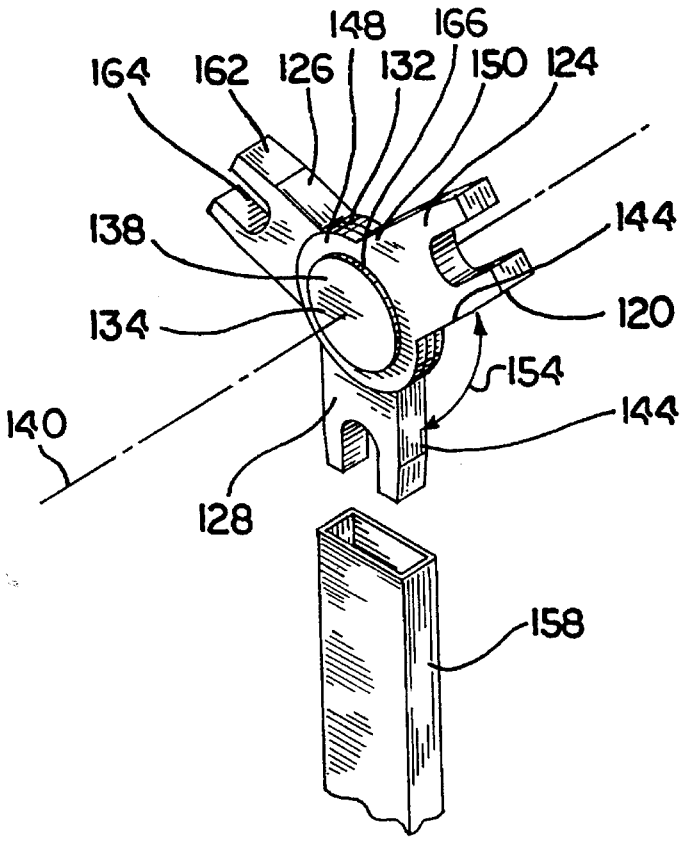

FIG. 11 is a perspective assembly view of a muntin bar joiner and muntin bar according to the present invention.

Figure 12:
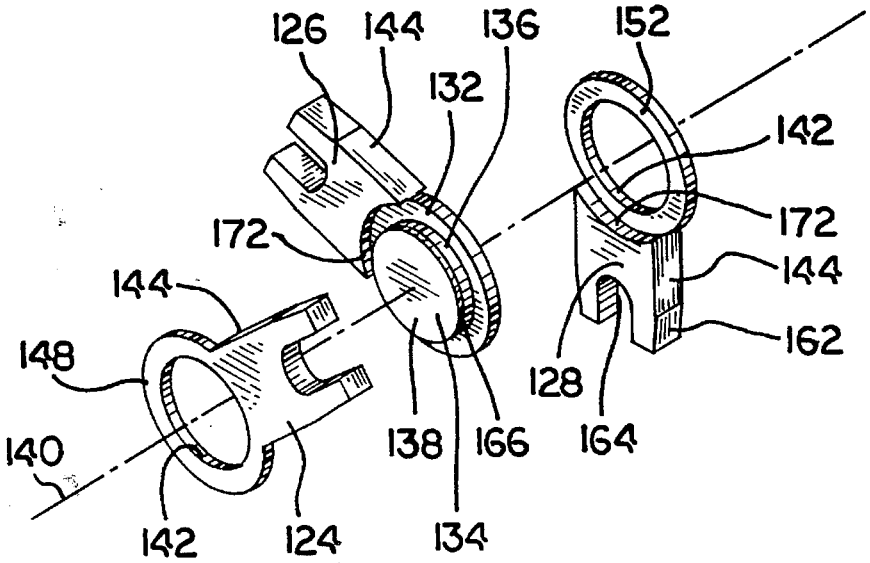

FIG. 12 is an exploded assembly view of a muntin bar joiner according to the present invention.

Figure 13:
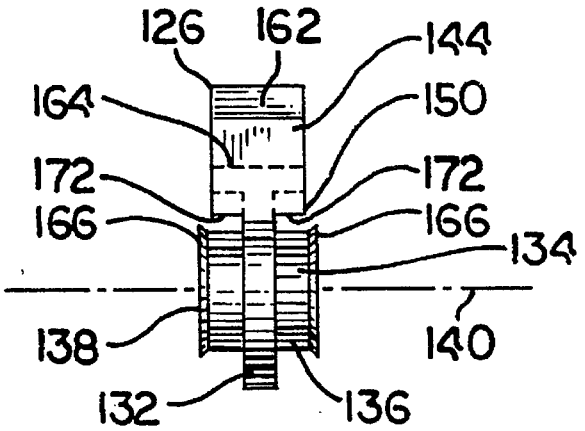

FIG. 13 is a side view of a core with tab of the assembly shown in FIG. 12.

Figure 14:
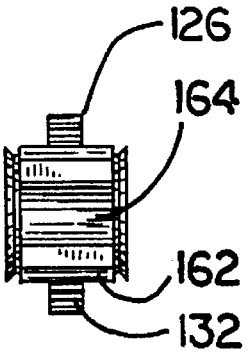

FIG. 14 is a top view of the core with tab shown in FIG. 13.

Figure 15:
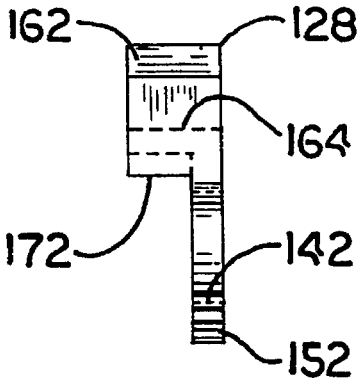

FIG. 15 is a side view of an adjustable tab of the assembly shown in FIG. 12.

Figure 16:
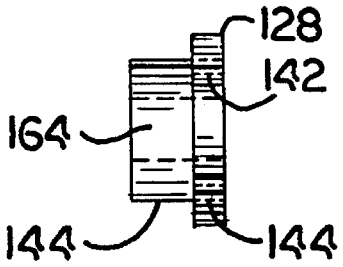

FIG. 16 is a bottom view of the adjustable tab shown in FIG. 15.

Figure 17:
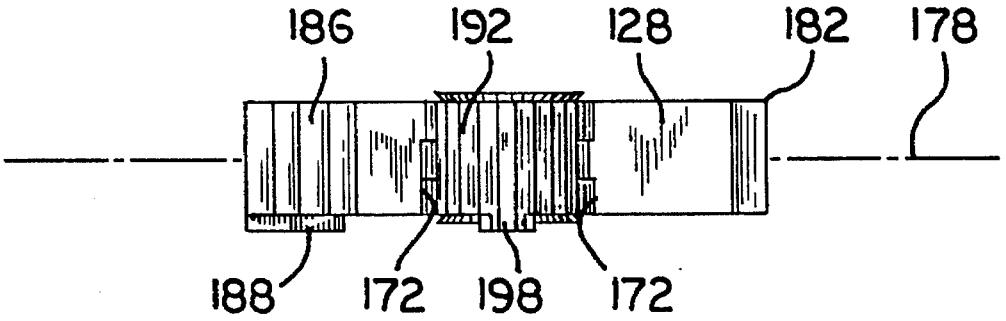

FIG. 17 is an edge view of a muntin bar joiner according to the present invention.

Figure 1:
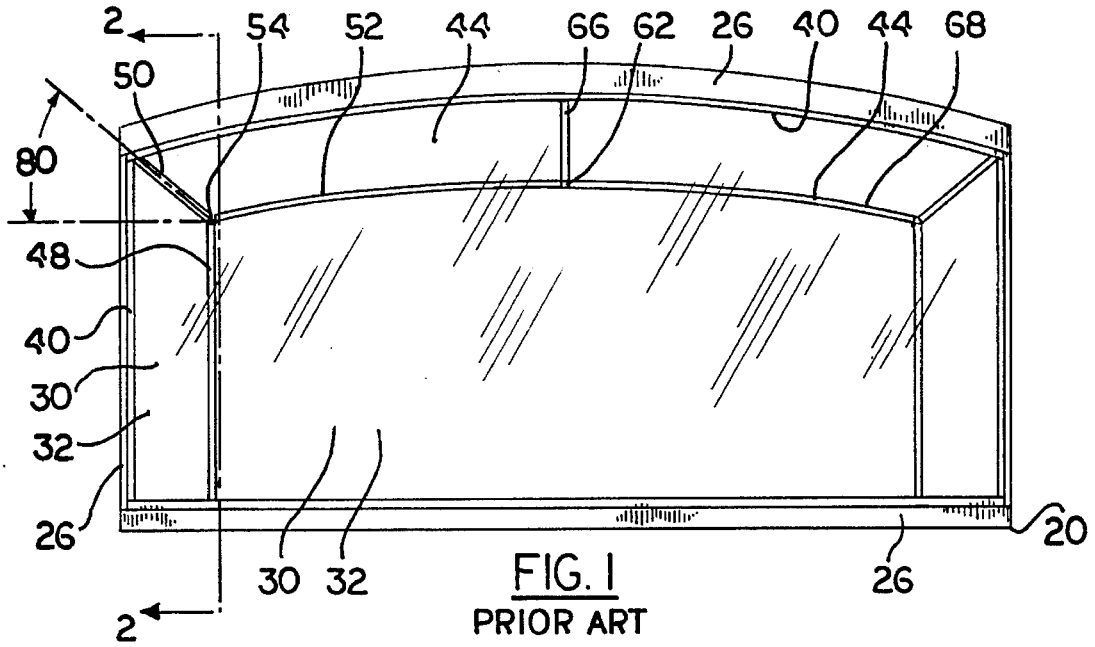
FIG. 1 PRIOR ART
Figure 2:
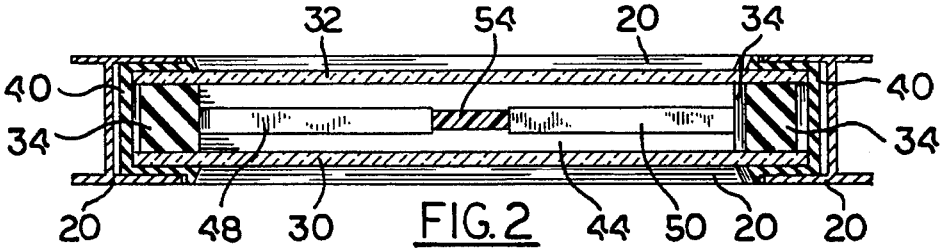
FIG. 2 PRIOR ART
Figure 3:
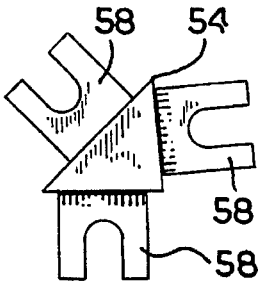
FIG. 3 PRIOR ART
Figure 4:
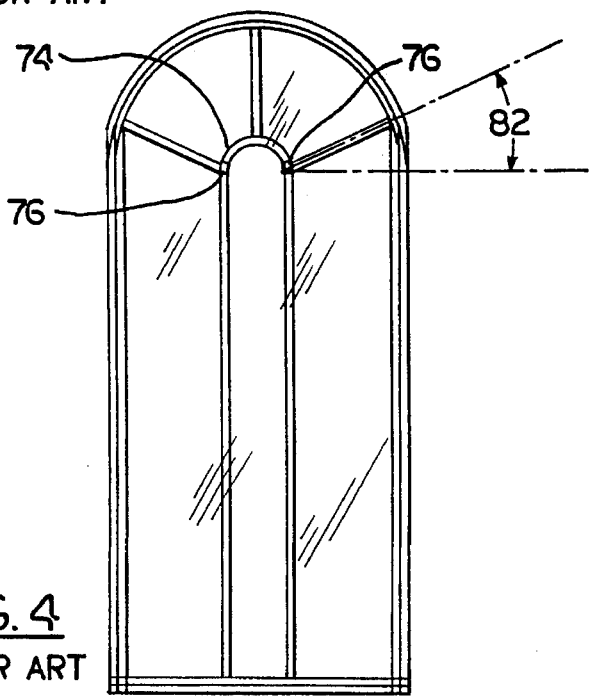
FIG. 4 PRIOR ART
Figure 5:
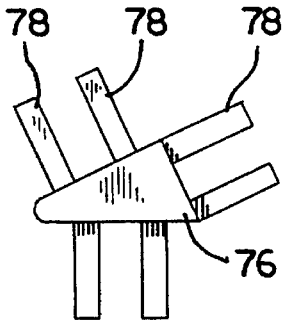
FIG. 5 PRIOR ART
Figure 8:
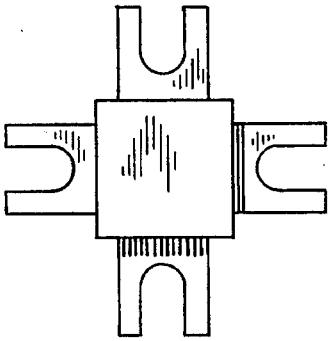
FIG. 8 PRIOR ART
Figure 6:
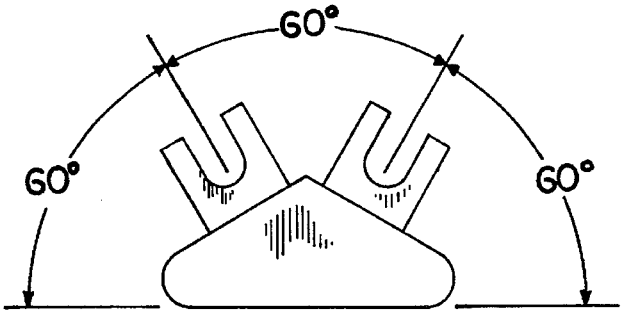
FIG. 6 PRIOR ART
Figure 9:
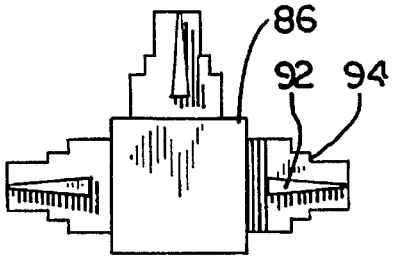
FIG. 9 PRIOR ART
Figure 7:
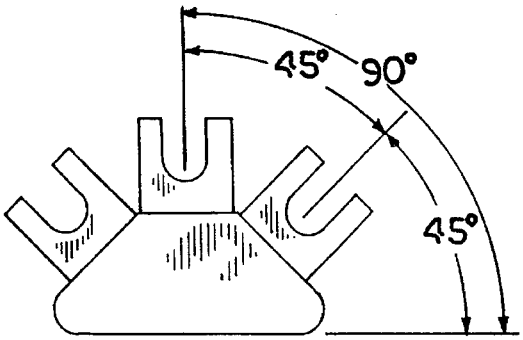
FIG. 7 PRIOR ART
Figure 10:
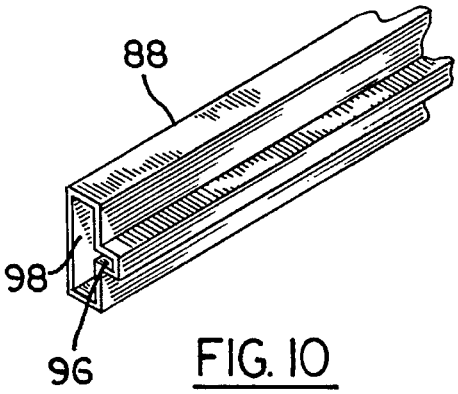
FIG. 10 PRIOR ART
Figure 18:
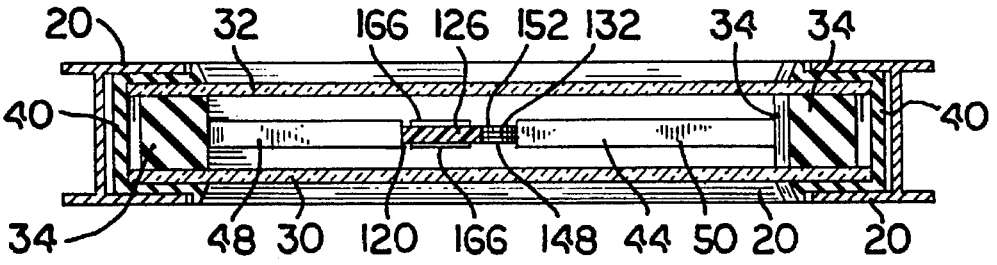

FIG. 18 is a cross section view of a window of the type shown in FIG. 2, having a muntin design assembly according to the present invention.

Figure 19:
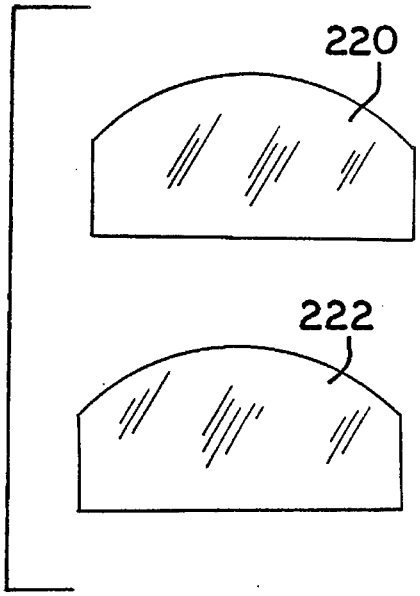

FIG. 19 is a schematic view of a step in the assembly of a muntin design window with the present invention.

Figure 20:
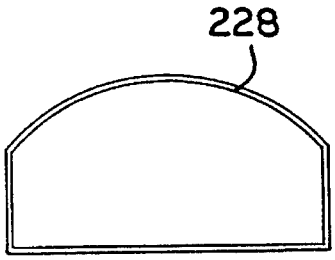

FIG. 20 is a schematic view of a step in the assembly of a muntin design window with the present invention.

Figure 21:
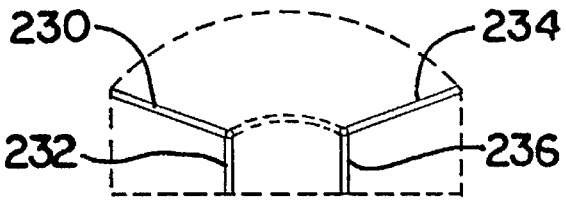

FIG. 21 is a schematic view of a step in the assembly of a muntin design window with the present invention.

Figure 22:
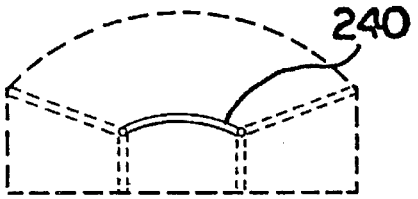

FIG. 22 is a schematic view of a step in the assembly of a muntin design window with the present invention.

Figure 23:
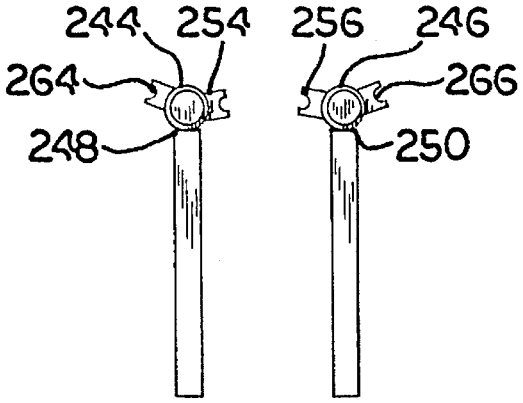

FIG. 23 is a schematic view of a step in the assembly of a muntin design window with the present invention.

Figure 24:
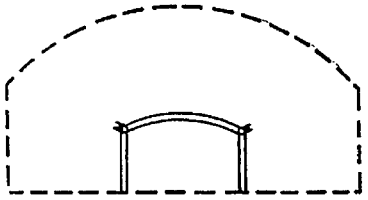

FIG. 24 is a schematic view of a step in the assembly of a muntin design window with the present invention.

Figure 25:
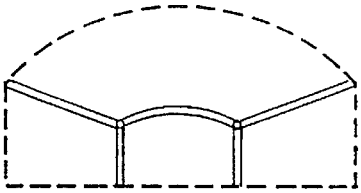

FIG. 25 is a schematic view of a step in the assembly of a muntin design window with the present invention.

Figure 26:
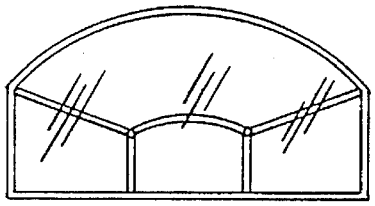

FIG. 26 is a schematic view of a step in the assembly of a muntin design window with the present invention.

DESCRIPTION OF THE PREFERRED EMBODIMENTS

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Referring to FIGS. 11 through 16, muntin bar joiner 120 includes adjustable attachment tabs 124, 126, and 128. Center tab 126 is attached to hub 132 of pivot core 134. Preferably center tab 126 and pivot core 134 are molded in one piece.

Adjustable attachment tab 124 is attached to, and preferably molded as one piece with hub 148. Adjustable attachment tab 128 is attached to, and preferably molded as one piece with hub 152. Adjustable attachment tabs 124 and 128 are preferably identical, the same piece being attachable to the front end 138 of the pivot core, or to the back end of the pivot core, by flipping the piece over. This reduces inventory cost.

Each of the tabs can be rotated independently about axis 140 of the core until shoulders 144 meet. The number of tabs, their width, the diameter of the hub, and position of adjacent tabs affects the limit of angular range of rotation of each tab.

For example, a ¾" diameter hub 148, or ⅜" radius to the base 150 of the shoulder, permits angle 154 going to 90 degrees with a 9/16" wide muntin bar 158. A larger hub would permit going to a smaller angle.

Each attachment tab 124, 126 and 128 is adapted to receive a bar of the muntin assembly, similar to bar 158. Chamfer 162 eases entry of the tab into the opening in the bar. Recess 164 saves construction material in order to lower cost.

Tab 124 snaps on the front end 138 of pivot core 134, behind retainer lip 166, and stops against hub 132. Preferably each hub takes the form of an annular ring which is not only a stop as above, but which serves as a bearing for smoothness of rotation between tabs during adjustment of the tabs.

Reduced diameter 136 of the pivot core closely and slidingly fits inner diameter 142 of hub 148 of tab 124.

In like manner, tab 128 snaps on the back side of core 34.

Preferably, tab 126, hub 132, and pivot core 134 are molded as one piece. In this single unit molded piece, retainer lip 166 and pivot core 134 move with tab 126 as tab 126 is rotated about axis 140 to a desired angle with respect to the other tabs.

Tab 126 and hub 132 may, however, be molded as one piece. Then it is snapped on the pivot core similarly to installation of tabs 124 and 128 on the pivot core.

Step 172 on the tabs provides for close sliding fit between the tabs and permits the tabs to be located in a common plane 178 as shown in muntin bar joiner 182 in FIG. 17. The tabs, when rotating, may move in the same plane while portions of the tabs near the pivot core move over one another.

Muntin bar joiner 182 includes tab 128 as in muntin bar joiner 120, and graduated-step tab 186 with ridge key 188, and graduated step tab 192 with graduated step key 198, which were snapped together on a pivot core for custom fit with muntin bars of a special design, not shown.

FIG. 18 shows a muntin design as in FIG. 2, in cross section with muntin bar joiner 120.

Although the adjustable tab preferably is shaped to attach to the muntin bar by friction, it is within the contemplation of the invention that the tab may be replaced by means for attaching to the muntin bar by cement, ultrasonic welding, cross pin, or other attachment means.

A method for making a muntin design window according to the present invention will now be described with reference to FIGS. 19–26.

a. Cut two pieces of glass 220 and 222 to a desired size and shape, FIG. 19, and put the glass through a washing machine.

b. Apply an appropriate type of spacer/sealer 228 such as Swiggle (tm) to a first of the pieces of glass, following the outer edge, FIG. 20.

c. Cut to length and clean the selected color and correct quantity of straight muntin bars 230, 232, 234, and 236, FIG.

21.

d. Cut a muntin bar long enough to roll form the muntin bar to the correct diameter and shape for the curved muntin 240; clean the bar when finished, FIG. 22.

e. Insert a correct color three-way muntin bar joiner with adjustable tabs 244, 246, into a first end 248, 250 of each of the two vertical muntin bars, FIG. 23.

f. Rotate one of the two free tabs 254, 256 on each muntin bar joiner to the proper angle to receive the curved muntin bar 240, and insert the tabs into the curved bar, FIG. 24.

g. Insert the remaining free tab 264, 266 on each muntin bar joiner in straight bars 230 and 234 and rotate each straight bar about the central axis of the respective muntin bar joiner by way of the tab on which it is mounted, until the bars are at the angles specified for the muntin design between the pieces of glass, and install the muntin assembly within the Swiggled boundary of the first piece of glass, FIG. 25.

h. Assure that the glass and bars are free of foreign particles, lay the second piece of glass on the Swiggle, and run the unit through a heater for insulated glass to seal the glass to the Swiggle, FIG. 26.

In a non-standard muntin design, taking into account the variability of Swiggled glass from window assembly to window assembly, it is usually necessary to hand fabricate custom plastic clips for the muntin bars to fit each individual application. The adjustable three-way muntin bar joiner of the present invention eliminates that problem.

It is seen from the above description of the invention that the invention provides the objects of providing a muntin bar joiner in which the attachment tabs are infinitely adjustable within a predetermined angular range, that the adjustable attachment tab be removable and interchangeable with another of a different type.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. A muntin bar assembly mounted in a window including a first light, a second light, and spacing means attached at the periphery of said first and second lights for maintaining said lights parallel to and facing one another, said muntin being mounted between said lights and comprising:

a first muntin bar having a first end and a second end, a second muntin bar having a first end and a second end, rotatable muntin bar joiner means having an axis, and comprising first muntin bar attachment means and second muntin bar attachment means rotatable with respect to one another, about said axis, said first end of said first muntin bar being attached to said joiner means by said first muntin bar attachment means, and said second end of said first muntin bar extending toward said spacing means, and said first end of said second muntin bar being attached to said joiner means by said second muntin bar attachment means, and said second end of said second muntin bar extending toward said spacing means, said rotatable muntin bar joiner means comprising pivot core means centered on said axis for supporting said first and second muntin bar attachment means for said rotation of said muntin bar attachment means about said axis, said second muntin bar attachment means being molded as one piece with said pivot core means, said joiner means being spaced from said periphery by said muntin bars.

2. A muntin bar assembly mounted in a window including a first light, a second light, and spacing means attached at the periphery of said first and second lights for maintaining said lights parallel to and facing one another, said muntin being mounted between said lights and comprising:

a first muntin bar having a first end and a second end, a second muntin bar having a first end and a second end, rotatable muntin bar joiner means having an axis, and comprising first muntin bar attachment means and second muntin bar attachment means rotatable with respect to one another, about said axis, said first end of said first muntin bar being attached to said joiner means by said first muntin bar attachment means, and said second end of said first muntin bar extending toward said spacing means, and said first end of said second muntin bar being attached to said joiner means by said second muntin bar attachment means, and said second end of said second muntin bar extending toward said spacing means, said rotatable muntin bar joiner means comprising pivot core means centered on said axis for supporting said first and second muntin bar attachment means for said rotation of said muntin bar attachment means about said axis, said first muntin bar attachment means being removably attached to said pivot core means, said second muntin bar attachment means being molded as one piece with said pivot core means, and said first muntin bar attachment means being rotatable about said pivot means for changing the radial angle between said first and second attachment means with respect to said axis, said joiner means being spaced from said periphery by said muntin bars.

3. A Muntin bar joiner mounted in a window, said window having a periphery, the joiner comprising:

an axis, pivot core means centered on said axis, first muntin bar attachment means, mounted on said pivot core means, for rotation about said axis, second muntin bar attachment means, mounted on said pivot core means, for rotation about said axis with respect to said first muntin bar attachment means, said first muntin bar attachment means being removably held on said pivot core means, said second muntin bar attachment means being molded as one piece with said pivot core means, muntin bar attachment means mounted on said pivot core means, said pivot core means being spaced from said periphery by the attachment of a plurality of muntin bars.

4. The muntin bar joiner described in claim 3, further comprising:

retainer means on said pivot core means for said removable holding of said first muntin bar dedicated attachment means on said pivot core, and for holding a third muntin bar dedicated attachment means.

5. The muntin bar joiner described in claim 4, further comprising:

said pivot core means including a first axial end and a second axial end, said retainer means comprising said first axial end.

6. A Muntin bar joiner mounted in a window, said window having a periphery, the joiner comprising:

an axis, pivot core means centered on said axis, first muntin bar attachment means, mounted on said pivot core means, for rotation about said axis, second muntin bar attachment means, mounted on said pivot core means, for rotation about said axis with respect to said first muntin bar attachment means, said first muntin bar attachment means being removably held on said pivot core means, retainer means on said pivot core means for said removable holding of said first muntin bar attachment means on said pivot core, said pivot core means including a first axial end and a second axial end, said retainer means comprising said first axial end, said retainer means further comprising a raised portion of said pivot core means, said pivot core means being spaced from said periphery by the attachment of a plurality of muntin bars.

* * * * *